United States Patent [19]

Silverberg

[11] 4,279,496

[45] Jul. 21, 1981

[54] BELT SUPPORT SYSTEM

[75] Inventor: Morton Silverberg, Rochester, N.Y.

[73] Assignee: Xerox Corporation, Stamford, Conn.

[21] Appl. No.: 41,049

[22] Filed: May 21, 1979

[51] Int. Cl.[3] ..... G03G 15/00

[52] U.S. Cl. ..... 355/3 BE; 271/34; 271/275; 355/16

[58] Field of Search ..... 355/3 BE, 16; 74/232–239, 242–242.7; 271/34, 194–197, 275; 198/790

[56] References Cited

U.S. PATENT DOCUMENTS

| | | | |
|---|---|---|---|
| 3,353,420 | 11/1967 | Rivers | 74/242.1 R |
| 3,646,866 | 3/1972 | Baltazzi et al. | 355/16 X |
| 3,734,490 | 5/1973 | Parks | 271/34 |
| 3,788,203 | 1/1974 | Rhodes | 354/3 |
| 4,025,068 | 5/1977 | Collins | 271/34 |
| 4,062,631 | 12/1977 | Ichikawa et al. | 355/16 X |
| 4,088,224 | 5/1978 | Kittredge | 198/790 X |
| 4,144,808 | 3/1979 | Iwasa et al. | 355/3 BE |

*Primary Examiner*—Richard L. Moses

*Attorney, Agent, or Firm*—H. M. Brownrout; H. Fleischer

[57] ABSTRACT

An apparatus in which a belt is supported by a fixed mounting and a movable mounting. In the operative position, the fixed mounting maintains at least a portion of the belt generally planar. During operation, the movable mounting deflects the planar portion of the belt to the operative position. In order to remove the belt, the movable mounting is returned to the inoperative position with the belt being undeflected. This facilitates removal of the belt from the mounting.

9 Claims, 4 Drawing Figures

BELT SUPPORT SYSTEM

This invention relates generally to an apparatus for supporting a photoconductive belt utilized in an electrophotographic printing machine. In an electrophotographic printing machine, it is frequently necessary to remove the photoconductive belt at periodic intervals and replace it with a new one. Typically, a photoconductive belt may be utilized for about forty to fifty thousand copies. At this time, the photoconductive belt frequently starts to deteriorate resulting in copies of less than optimum quality. Hence, it is highly desirable to be able to readily remove the photoconductive belt from the printing machine and to replace it with a new one.

In electrophotographic printing, the photoconductive belt is charged to a substantially uniform potential so as to sensitize its surface. The charged portion of the photoconductive surface is exposed to a light image of an original document being reproduced. This records an electrostatic latent image on the photoconductive surface corresponding to the informational areas contained within the original document being reproduced. After the electrostatic latent image is recorded on the photoconductive surface, the latent image is developed by bringing a developer mixture of carrier granules and toner particles into contact therewith. The toner particles are attracted from the carrier granules to the latent image forming a toner powder image on the photoconductive surface. After the toner powder image has been transferred to the copy sheet, it is generally heated to permanently affix it to the copy sheet, in image configuration. This general approach was disclosed by Carlson in U.S. Pat. No. 2,297,691, and has been further amplified and described by many related patents in the art.

Since the photoconductive belt has a finite life, it should be readily replaceable in the printing machine. As the photoconductive belt deteriorates, after extensive usage, copy quality starts to degradate. At this time, the operator should be readily able to remove the used photoconductive belt from the from the printing machine and to insert a new photoconductive belt therein. Recently, pneumatic systems have been developed for providing a fluid support for the photoconductive belt. It would be highly advantageous to be able to utilize the features of the pneumatic system to provide a retractable system facilitating belt removal from the printing machine.

Various types of devices have been developed for supporting a photoconductive belt. The following art appears to be relevant:

U.S. Pat. No. 3,435,693; Patentee: Wright et al.; Issued: Apr. 1, 1969.

U.S. Pat. No. 4,025,068; Patentee: Collins; Issued: May 24, 1977.

Co-pending U.S. Patent application Ser. No.: 23,936; Filed: Mar. 21, 1979.

The pertinent portions of the foregoing art may be briefly summarized as follows:

Wright et al. discloses a photoconductive belt entrained about a plurality of spaced rollers. The belt passes over a vacuum platen which maintains it in a flat position at the exposure station.

Collins describes a sheet feeder having a belt mounted on a pair of spaced rollers. A spring resiliently urges a tension roller against the belt to maintain a preselected tension under operating conditions. A retard roller having a flat region on the periphery thereof passes against the belt. The retard roller is mounted eccentrically on a shaft. When the flat region of the roller is adjacent the belt, the belt may be readily removed from the rollers.

The co-pending U.S. Patent application discloses a cleaning system in which a pneumatic system deflects a belt into engagement with a cleaning roller. The pneumatic system includes a bellows contacting the belt and in communication with a blower. When the blower is actuated, pressurized air causes the bellows to expand deflecting the belt against the cleaning roller.

In accordance with the features of the present invention, there is provided an apparatus for removably supporting a belt. Means, mounted fixedly, support the belt and maintain at least a portion thereof generally planar in the inoperative position. Means, mounted movably, deflect the generally planar portion of the belt to the operative position. Means, coupled to the movable mounting means, move the movable mounting means to deflect the belt to the operative position and return the belt to the inoperative position. In the inoperative position, removal of the belt from the fixed mounting means and the movable mounting means, and the replacement thereof with an unused belt is facilitated.

Other aspects of the present invention will become apparent as the following description proceeds and upon reference to the drawings, in which.

While the present invention will hereinafter be described in connection with a preferred embodiment thereof, it will be understood that it is not intended to limit the invention to this embodiment. On the contrary, it is intended to cover all alternatives, modifications and equivalents as may be included within the spirit and scope of the invention as defined by the appended claims.

Figure 1:
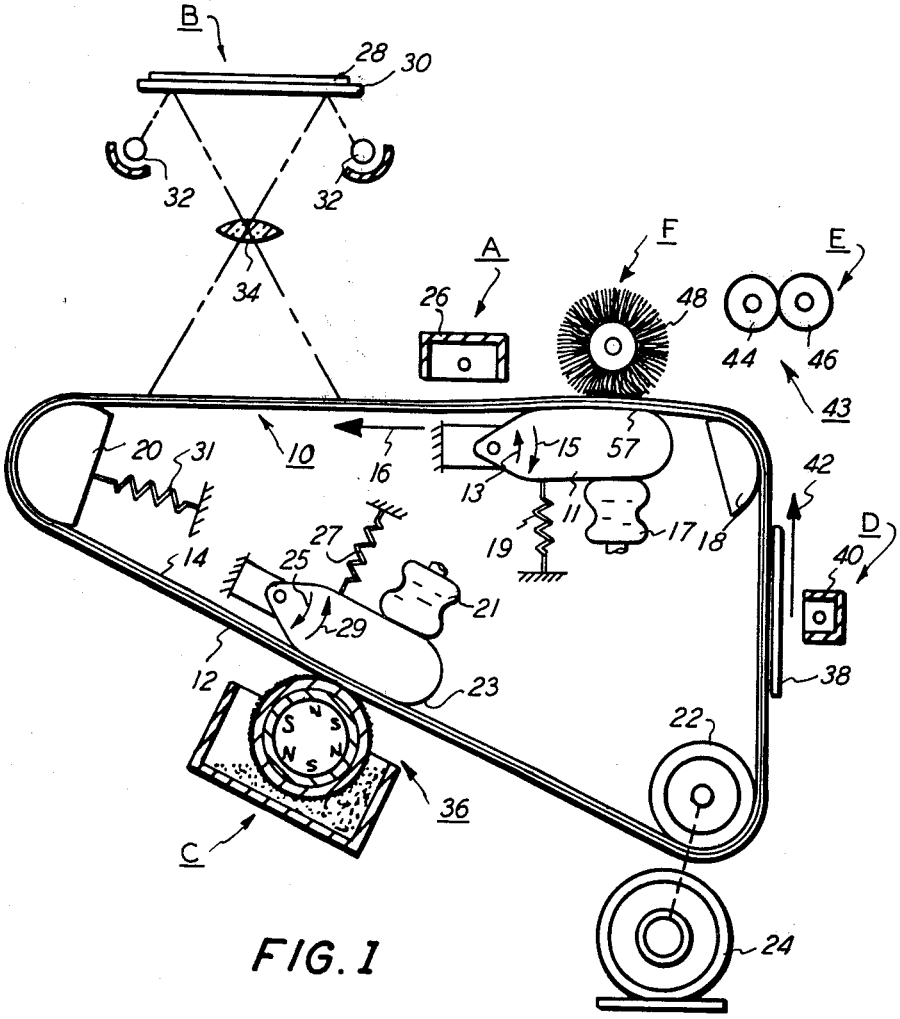
FIG. 1 is a schematic elevational view illustrating an electrophotographic printing machine incorporating the features of the present invention therein.

For a general understanding of the features of the present invention, reference is had to the drawings. In the drawings, like reference numerals have been used throughout to designate identical elements. FIG. 1 schematically depicts the various components of an illustrative electrophotographic printing machine incorporating the belt mounting apparatus of the present invention therein. It will become evident from the following discussion that this apparatus is equally well suited for use with a wide variety of belts and is not necessarily limited in its application to the particular embodiment shown herein.

Inasmuch as the art of electrophotographic printing is well known, the processing stations in the FIG. 1 printing machine will be shown hereinafter schematically and their operations will be described briefly with reference thereto.

As shown in FIG. 1, the electrophotographic printing machine employs a belt 10 having a photoconductive surface 12 deposited on a conductive substrate 14. Preferably, photoconductive surface 12 is made from a selenium alloy with conductive substrate 14 being made from an aluminum alloy. Belt 10 moves in the direction of arrow 16 to advance successive portions of photoconductive surface 12 sequentially through the various processing stations disposed about the path of movement thereof. Belt 10 is entrained about fixed air post 18, tension post 20, and drive roller 22. Drive roller 22 is mounted rotatably and in engagement with belt 10. Motor 24 rotates drive roller 22 to advance belt 10 in the direction of arrow 16. Roller 22 is coupled to motor 24 by a suitable means such as a drive belt. Movable mounting 11 pivots, in the direction of arrow 13, to deflect belt 10 away from the tangential plane to an operative position relative to cleaning brush 48. When the printing machine is inoperative, mounting 11 pivots in the direction of arrow 15 to return belt 10 to the tangential plane. Expansion of bellows 17 causes movable mounting 11 to pivot to the operative position. When bellows 17 is unexpanded, spring 19 resiliently urges movable mounting 11 to pivot in the direction of arrow 15 returning belt 10 to the inoperative position. Similarly, expansion of bellows 21 causes movable mounting 23 to pivot in the direction of arrow 25 deflecting belt 10 to the operative position relative to development roller 36. When bellows 21 is unexpanded, spring 27 pivots movable mounting 23 in the direction of arrow 29 returning belt 10 to the tangential plane. Tension post 20 is resiliently urged against belt 10 by spring 31. To facilitate the removal of belt 10, movable mountings 11 and 23 are pivoted to the inoperative position and spring 31 is extended reducing the tensile force applied on belt 10. In the inoperative position, i.e. when belt 10 may be removed from the supports thereof, the generally planar portions of belt 10 are undeflected being located in the tangential plane. Movable mountings 11 and 23 are substantially identical, only the processing station with which each is associated being different. Similarly, posts 18 and 20 are identical. Hence, only the detailed structure of movable mounting 11 and air post 18 will be described hereinafter with reference to FIGS. 3 and 4.

With continued reference to FIG. 1, initially a portion of belt 10 passes through charging station A. At charging station A, a corona generating device, indicated generally by the reference numeral 26, charges photoconductive surface 12 of belt 10 to a relatively high, substantially uniform potential.

Next, the charged portion of photoconductive surface 12 passes through exposure station B. At exposure station B, an original document 28 is positioned face-down upon transparent platen 30. Lamps 32 flash light rays onto original document 28. The light rays reflected from original document 28 are transmitted through lens 34 forming a light image thereof. The light image is focused on the charged portion of photoconductive surface 12 to selectively dissipate the charge theron. This records an electrostatic latent image on photoconductive surface 12 which corresponds to the informational areas contained within original document 28.

Thereafter, belt 10 advances the electrostatic latent image recorded on photoconductive surface 12 to development station C. At development station C, movable mounting 23 deflects the generally planar portion of belt 10 from the tangential plane to the operative position wherein belt 10 is spaced about 0.15 centimeters from magnetic brush developer roller 36. Magnetic brush developer roller 36 advances the developer mix into contact with the electrostatic laten image. The latent image attracts the toner particles from the carrier granules forming a toner powder image on photoconductive surface 12 of belt 10.

Belt 10 then advances the toner powder image to transfer station D. At transfer station D, a sheet of support material 38 is moved into contact with the toner powder image. The sheet of support material is advanced by the sheet feeding apparatus to transfer station D. Preferably, the sheet feeding apparatus includes a feed roll contacting the uppermost sheet of a stack of sheets. The feed roll rotates to advance the uppermost sheet from the stack into a chute. The chute directs the advancing sheet of support material into contact with photoconductive surface 12 of belt 10 in a timed sequence to that the toner powder image developed thereon contacts the advancing sheet of support material at transfer station D.

Transfer station D includes a corona generating device 40 which sprays ions onto the backside of sheet 38. This attracts the toner powder image from photoconductive surface 12 to sheet 38. After transfer, the sheet continues to move in the direction of arrow 42 onto a conveyor (not shown) which advances the sheet to fusing station E.

Fusing station E includes a fuser assembly, indicated generally by the reference numeral 43, which permanently affixes the transferred toner powder image to sheet 38. Preferably, fuser assembly 43 includes a heated fuser roller 44 and a back-up roller 46. Sheet 38 passes between fuser roller 44 and back-up roller 46 with the toner powder image contacting fuser roller 44. In this manner, the toner powder image is permanently affixed to sheet 38. After fusing, a chute guides the advancing sheet 38 to a catch tray for subsequent removal from the printing machine by the operator.

Invariably, after the sheet of support material is separated from photoconductive surface 12 of belt 10, some residual particles remain adhering thereto. These residual particles are removed from photoconductive surface 12 at cleaning station F. Cleaning station F includes a rotatably mounted fibrous brush 48, adapted to remove the residual toner particles adhering to photoconductive surface 12. Movable mounting 11 deflects the generally planar portion of belt 10 from the tangential plane to the operative position wherein belt 10 interfers with the tips of brush 48. Preferably, the interference between belt 10 and the tips of brush 48 is about 0.15 centimeters. After cleaning, a discharge lamp (not shown) floods photoconductive surface 12 with light to dissipate any residual electrostatic charge remaining thereon prior to the charging thereof for the next successive imaging cycle.

After a large number of copies have been reproduced by the electrophotographic printing machine, the photoconductive belt starts to deteriorate producing copies of less than optimum quality. At this time, it is highly desirable to remove the old photoconductive belt and replace it with a new photoconductive belt. The operator is alerted to this condition by a display, i.e. a warning light, indicating that the photoconductive belt should be replaced. The warning light is actuated by the machine logic which tracks the number of copies reproduced. Thus, the machine logic is set to activate the warning light after a pre-determined number of copies have been reproduced. At this time, movable mountings 11 and 23 are returned to the inoperative position and spring 31 is extended reducing the tension in belt 10. This readily enables the operator to slide belt 10 from the printing machine. A pneumatic system is associated with movable mountings 11 and 23 to automatically return mountings 11 and 23 to the inoperative position when actuated by the machine logic system or the operator so as to permit belt 10 to be removed from the printing machine.

It is believed that the foregoing description is sufficient for purposes of the present application to illustrate the general operation of an electrophotographic printing machine incorporating the features of the present invention therein.

Figure 2:
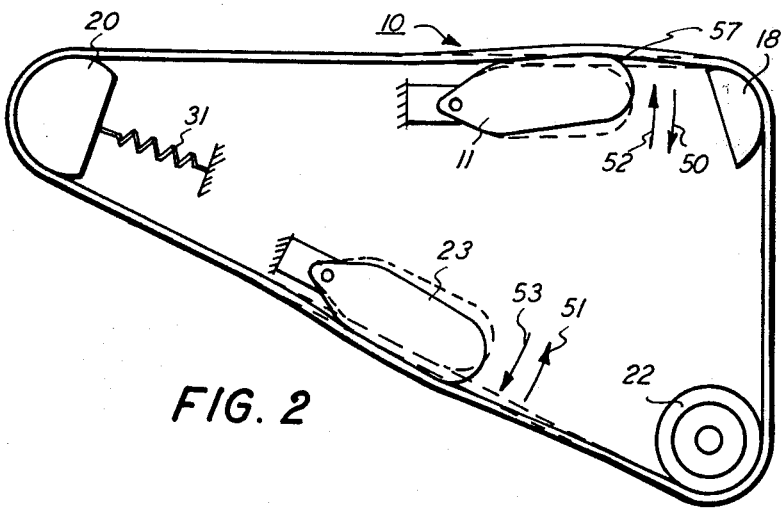
FIG. 2 is a schematic elevational view depicting the movable mounting of the FIG. 1 printing machine deflecting the belt.

Referring now to the specific subject matter of the invention, FIG. 2 shows movable mounting members 11 and 23 in the operative and inoperative positions. As shown therein, movable mounting members 11 and 23 are moved in the direction of arrows 50 and 51, respectively, to return belt 10 to the inoperative position with belt 10 being in the tangential plane. Spring 31 is extended to further facilitate the removal of belt 10 from mountings 18 and 20, and roller 22. After the old photoconductive belt is removed from the printing machine, a new photoconductive belt is placed over mounting 18, mounting 20 and drive roller 22. Thereafter, the pneumatic system is actuated to move mountings 11 and 23 in the direction of arrows 52 and 53 so as to deflect belt 10 placing it in the operative position.

Figure 3:
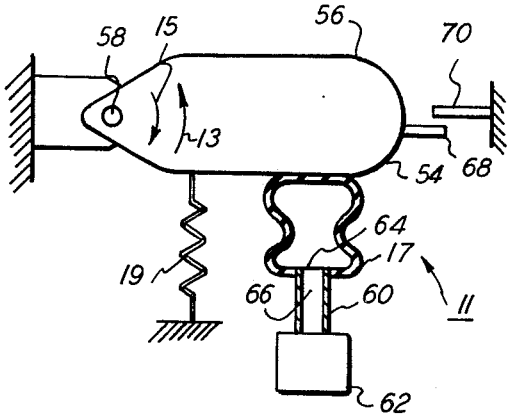
FIG. 3 is a schematic elevational view showing the movable mounting of the FIG. 1 printing machine.

Referring now to FIG. 3, the detailed structure of movable mounting member 11 and the pneumatic system associated therewith will now be described. As shown in FIG. 3, movable mounting 11 includes a support 54 having a generally planar exterior surface 56 opposed from belt 10. Support 56 is mounted pivotably on pin 58 so as to enable it to pivot in the direction of arrows 13 and 15. Conduit 60 couples blower 62 with the interior chamber 64 of bellows 17. In this manner, pressurized air flows from blower 62, in the direction of arrow 66, through conduit 60 into chamber 64 of bellows 17. The pressurized air causes bellows 17 to expand pivoting support 56 in the direction of arrow 13 to deflect belt 10 to the operative position. Support 56 pivots, in the direction of arrow 12, until stop 68 engages stop 70 located in cleaning station F. Belt 10 is deflected a distance sufficient to interfere with the tips of brush 48 by about 0.15 centimeters.

A suitable valve assembly is positioned in conduit 60 and provides for introducing compressed air to the interior chamber 64 of bellows 17. As the compressed air enters chamber 64, bellows 17 expands. When blower 62 is de-energized, the valve is opened. This permits the compressed air within chamber 64 of bellows 17 to be vented to the atmosphere. As the compressed air in chamber 64 of bellows 17 vents to the atmosphere, spring 19 resiliently urges support 56 to pivot in the direcion of arrow 15 returning belt 10 to the inoperative position, i.e. the tangential plane, where it may be readily removed from mountings 18 and 20, and drive roller 22.

During operation, after a pre-determined number of copies have been reproduced, the machine logic actuates the warning display and positions the valve in the opened position venting the compressed air in chamber 64 of bellows 17 to the atmosphere. Alternatively, the machine operator may manually open the valve. When the valve is in the opened position, the compressed air in interior chamber 64 of bellows 17 is vented to the atmosphere. At this time, the machine logic de-energizes blower 62. This causes bellows 17 to retract and spring 19 to pivot support 56 away from belt 10, in the direction of arrow 15.

It is clear that the pneumatic system, associated with movable mounting 11, provides a pressurized fluid for automatically moving support 56 toward and away from belt 10. In this way, mounting 17 is maintained in the operative position during the useful life of belt 10 and retracted therefrom so as to permit a new photoconductive belt to be positioned thereover.

After the new photoconductive belt is positioned about mountings 18, and 20, and drive roller 22, the operator actuates the machine logic energize blower 62 and return the valve to the closed position. Once again, the compressed air entering chamber 64 of bellows 17 causes bellows 17 to expand moving support 56 and the new belt to the operative position.

Figure 4:
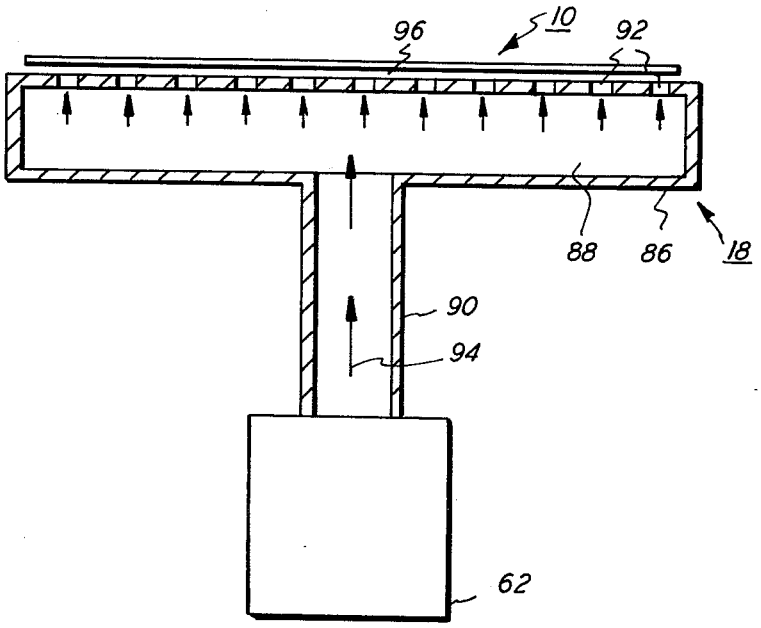
FIG. 4 is a sectional elevational view depicting a fixed air post providing support for the belt of the FIG. 1 printing machine.

Referring now to FIG. 4, there is shown the detailed structure of mountings 18. As depicted thereat, mounting 18 comprises a substantially cylindrical post 86 defining an interior chamber 88. Conduit 90 couples blower 62 with chamber 88. Post 86 has a plurality of apertures 92 or holes in the circumferential surface thereof in the region where belt 10 passes thereover. In operation, blower 62 produces a flow of compressed air which passes through conduit 90, in the direction of arrows 96, into chamber 88. The compressed air egresses from chamber 88 via holes 92 into gap 96 between belt 10 and the circumferential surface of post 86. The compressed air forms a fluid film in gap 96 which at least partially or entirely supports belt 10. This fluid film provides a substantially frictionless support between post 86 and belt 10. Mounting 20 is substantially identical to mounting 18.

In recapitulation, it is evident that the apparatus of the present invention provides a movable support for a moving belt. This support deflects the belt during operation. In addition, the support is retractable so as to return the belt to the tangential plane enabling a used belt to be readily removed from the mounting and facilitating the replacement thereof with a new belt. The foregoing is achieved by a pneumatic system which provides compressed air to automatically move the support to the operative position and return it to the inoperative position. In this manner, the pneumatic system automatically retracts the movable support after the belt starts to degradate in performance enabling the ready removal of the belt from the printing machine.

It is, therefore, evident that there has been provided in accordance with the present invention an apparatus which fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations that fall within the spirit and broad scope of the appended claims.

What is claimed is:

1. An apparatus for removably supporting a belt, including:

means mounted fixedly for supporting the belt and maintaining at least a portion thereof generally planar in an inoperative position;

means, mounted movably, for deflecting the planar portion of the belt to an operative position; and means, coupled to said movable mounting means, for moving said movable mounting means to deflect the belt to the operative position and to return the belt to the inoperative position facilitating removal of the belt from said fixed mounting means and said movable mounting means and the replacement thereof with an unused belt, said moving means includes pneumatic means in communication with said movable mounting means, said pneumatic means includes a bellows coupled to said movable mounting means, and means for supplying a pressurized fluid to said bellows expanding said bellows to move said movable mounting means and the belt to the operative position, said fixed mounting means includes a post defining an interior chamber in communication with said supplying means and having a plurality of apertures in the periphery thereof through which pressurized fluid flows to form a fluid film between said post and the portion of the belt passing thereover.

2. An apparatus as recited in claim 1, wherein said moving means includes means for resiliently urging said movable mounting means to return to the inoperative position.

3. An apparatus as recited in claim 1, wherein said fixed mounting means includes means for moving the belt along a pre-determined path.

4. An apparatus as recited in claim 3, wherein said moving means includes:

a drive roller in contact with the belt; and means for rotating said drive roller to move the belt along the pre-determined path.

5. An electrophotographic printing machine of the type comprising a photoconductive belt moving along a pre-determined path having a plurality of processing stations, wherein the improvement includes:

means, mounted fixedly, for supporting the photoconductive belt and maintaining at least a portion thereof generally planar in an inoperative position;

means, mounted movably, for deflecting the generally planar portion of the photoconductive belt to an operative position defining the location of the photoconductive belt with respect to the processing station opposed therefrom; and means, coupled to said movable mounting means, for moving said movable mounting means to deflect the photoconductive belt to the operative position and to return the photoconductive belt to the inoperative position facilitating the removal of a photoconductive belt from said fixed mounting means and said movable mounting means and the replacement thereof with an unused photoconductive belt, said moving means includes pneumatic means in communication with said movable mounting means, said pneumatic means includes a bellows coupled to said movable mounting means, and means for supplying a pressurized fluid to said bellows expanding said bellows to move said movable mounting means and the photoconductive belt to the operative position.

6. A printing machine as recited in claim 5, wherein said moving means includes means for resiliently urging said movable mounting means to return to the inoperative position.

7. A printing machine as in claim 5 or 6, wherein said fixed mounting means includes a post defining an interior chanber in communicaton with said supplying means and having a plurality of apertures in the periphery thereof through which pressurized fluid flows to form a fluid film between said post and the portion of the photoconductive belt passing thereover.

8. A printing machine as recited in claim 7, wherein said fixed mounting means includes means for moving the photoconductive belt along the predetermined path.

9. A printing machine as recited in claim 8, wherein said moving means includes:

a drive roller in contact with the photoconductive belt; and means for rotating said drive roller to move the photoconductive belt along the pre-determined path.

* * * * *